US010221752B2

(12) United States Patent
Yang et al.

(10) Patent No.: US 10,221,752 B2
(45) **Date of Patent: *Mar. 5, 2019**

(54) SPLIT COOLING APPARATUS FOR INTERNAL COMBUSTION ENGINE

(71) Applicants: Hyundai Motor Company, Seoul (KR); KIA Motors Corporation, Seoul (KR)

(72) Inventors: Kwang Sik Yang, Gunpo-si (KR); Min Seok Jang, Sr., Gumi-si (KR); Jun Sik Park, Seoul (KR); Woo Yong Lee, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/366,866

(22) Filed: Dec. 1, 2016

(65) Prior Publication Data

US 2017/0306833 A1 Oct. 26, 2017

(30) Foreign Application Priority Data

Apr. 20, 2016 (KR) ..... 10-2016-0048222

(51) Int. Cl.

| | |
|---|---|
| ***F01P 3/00*** | (2006.01) |
| ***F01P 7/16*** | (2006.01) |
| ***F01P 3/02*** | (2006.01) |

(52) U.S. Cl.

CPC ..... *F01P 7/16* (2013.01); *F01P 3/02* (2013.01); *F01P 2003/021* (2013.01)

(58) Field of Classification Search

CPC ... F01P 3/02; F01P 2003/021; F01P 2007/143
USPC ..... 123/41.01, 41.02, 41.08, 41.09, 41.17, 123/41.31, 41.44, 196 AB
See application file for complete search history.

(56) References Cited

U.S. PATENT DOCUMENTS 6,581,550 B2 * 6/2003 Shinpo ..... F01P 3/02 123/41.74
6,834,625 B2 * 12/2004 Matsutani ..... F01P 3/02 123/41.72

(Continued)

FOREIGN PATENT DOCUMENTS

JP 2008031939 A * 2/2008 ..... F02F 1/14
JP 2012-007478 A 1/2012

(Continued)

*Primary Examiner* — Marguerite McMahon
*Assistant Examiner* — Tea Holbrook
(74) *Attorney, Agent, or Firm* — Brinks Gilson & Lione

(57) ABSTRACT

The present disclosure provides a split cooling apparatus for an internal combustion engine, the apparatus including: a base inserted into a water jacket of a cylinder block, the base surrounding an outside of a cylinder along a shape of the cylinder; an insertion groove formed on the base by being depressed into an inner surface of the base; and a sealing member inserted into the insertion groove, wherein when a temperature of cooling water supplied into the water jacket reaches a preset temperature or higher, the sealing member expands so as to close a flow passage between the base and the cylinder, thereby increasing flow resistance of the cooling water and thus reducing a heat transfer rate of the cylinder.

9 Claims, 3 Drawing Sheets

(56) References Cited

U.S. PATENT DOCUMENTS

| | | | | |
|---|---|---|---|---|
| 6,874,451 | B2 * | 4/2005 | Matsutani | F01P 3/02 123/41.79 |
| 7,798,108 | B2 * | 9/2010 | Konishi | F02F 1/36 123/41.72 |
| 2003/0230253 | A1 * | 12/2003 | Matsutani | F01P 3/02 123/41.74 |
| 2005/0235930 | A1 * | 10/2005 | Xin | F02F 1/108 123/41.74 |
| 2008/0283001 | A1 * | 11/2008 | Konishi | F02F 1/108 123/41.72 |
| 2009/0194046 | A1 * | 8/2009 | Shikida | F02F 1/14 123/41.74 |
| 2010/0024748 | A1 * | 2/2010 | Chae | F01P 3/02 123/41.72 |
| 2010/0031902 | A1 * | 2/2010 | Alyanak | F02F 1/14 123/41.44 |
| 2010/0242868 | A1 * | 9/2010 | Shikida | F01P 3/02 123/41.79 |
| 2017/0167354 | A1 * | 6/2017 | Park | F02F 1/14 |
| 2017/0342939 | A1 * | 11/2017 | Araki | F02F 1/14 |
| 2017/0350302 | A1 * | 12/2017 | Araki | F02F 1/14 |

FOREIGN PATENT DOCUMENTS

| | | | | | |
|---|---|---|---|---|---|
| JP | 2012-172525 | A | | 9/2012 | |
| JP | 2015203313 | A | * | 11/2015 | |
| JP | 2015203315 | A | * | 11/2015 | |
| JP | 2017115613 | A | * | 6/2017 | F01P 3/02 |
| KR | 10-1998-0062657 | | | 10/1998 | |
| KR | 2010-0015060 | A | | 2/2010 | |
| KR | 2012-0060061 | A | | 6/2012 | |

* cited by examiner

SPLIT COOLING APPARATUS FOR INTERNAL COMBUSTION ENGINE

CROSS REFERENCE TO RELATED APPLICATION

The present application claims priority to Korean Patent Application No. 10-2016-0048222, filed Apr. 20, 2016, the entire contents of which is incorporated herein by reference in its entirety.

FIELD

The present disclosure relates generally to a cooling apparatus for an internal combustion engine and, more particularly, to a split cooling apparatus for an internal combustion engine.

BACKGROUND

The statements in this section merely provide background information related to the present disclosure and may not constitute prior art.

Generally, a conventional vehicle employs a siamese-type cylinder block in a multi-cylinder engine that is short in distance (bore pitch) between cylinders for the purpose of the reduction of the size, weight and entire length of the multi-cylinder engine. The siamese-type cylinder block is configured to be short in bore pitch since it has no water jacket (a cooling water passage) between cylinder liners and is formed by casting several cylinder liners using aluminum so as to combine them with each other.

Since the siamese-type cylinder block has a short distance in a portion (referred to as a siamese portion hereinbelow) between cylinder bores, it does not include the cooling water passage and thus is vulnerable to heat. Particularly, the siamese portion around an upper end part of the cylinder block to which heat from a combustion chamber is directly applied may become significantly high in temperature.

We have discovered that the high temperature that the siamese portion reaches causes a temperature difference between the siamese portion and a circumference thereof. Accordingly, an upper part of the cylinder block is thermally transformed greatly, and an epicenter of the cylinder bore is displaced. Further, engine oil may flow into a combustion chamber through a clearance occurring between a piston ring and an inner wall of a cylinder, which causes excessive consumption of the engine oil, and increases the amount of blow-by gas.

In the related art, to properly cool the siamese portion, slits or drilled holes formed in a portion between the cylinder bores, or wedge-shaped water holes formed through a cylinder head gasket that serve as a cooling water passage have been provided, but we have found that cooling efficiency thereof was low.

Particularly, in the related art, the following structures have been used: an insertion-type structure that improves a performance of an internal combustion engine by reducing an initial temperature of intake air by promoting a flow of cooling water in an upper part of an exhaust system of the cylinder block; and an insertion-type structure that divides a flow of cooling water into an upper flow and a lower flow for split cooling. However, the former structure is cast using a plastic, and due to a clearance for corresponding to a casting tolerance, the flow of the cooling water is distributed, which reduces cooling efficiency, whereas the latter structure requires an additional split cooling valve when applying an integrated flow control valve, which complicates the structure of an integrated valve and increases a size thereof.

The foregoing is intended merely to aid in the understanding of the background of the present disclosure, and is not intended to mean that the present disclosure falls within the purview of the related art that is already known to those skilled in the art.

Further areas of applicability will become apparent from the description provided herein. It should be understood that the description and specific examples are intended for purposes of illustration only and are not intended to limit the scope of the present disclosure.

SUMMARY

Accordingly, the present disclosure provides a split cooling apparatus for an internal combustion engine, in which the apparatus can realize split cooling in such a manner that the apparatus increases the temperature of an outer wall surface of a cylinder and promotes the flow of cooling water in an upper part of a cylinder block at the same time by reducing the heat transfer rate of the cylinder in a lower part of the cylinder block, thereby improving the performance of an internal combustion engine.

In order to achieve the above object, according to one aspect of the present disclosure, there is provided a split cooling apparatus for an internal combustion engine, the apparatus including: a base inserted into a water jacket of a cylinder block, the base surrounding an outside of a cylinder along a shape of the cylinder; an insertion groove formed on the base by being depressed into an inner surface of the base; and a sealing member inserted into the insertion groove, wherein when a temperature of cooling water supplied into the water jacket reaches a preset temperature or higher, the sealing member expands so as to close a flow passage between the base and the cylinder, thereby increasing flow resistance of the cooling water and thus reducing a heat transfer rate of the cylinder.

The base may be formed up to two thirds of a height of the cylinder block from a lower end of the cylinder block.

The insertion groove may be formed to have a closed curve extending along a longitudinal direction of the base.

The insertion groove may be formed on an upper part of the base.

The insertion groove may include a plurality of insertion grooves, the plurality of insertion grooves being arranged on the inner surface of the base by being spaced apart from each other at predetermined intervals in a vertical direction.

The sealing member may be made of an ethylene propylene diene m-class (EPDM) rubber, the sealing member being compressed after being formed so as to expand at the preset temperature or higher.

The base may be provided with a guide member at a siamese portion thereof.

The guide member may include a plurality of guide members, the plurality of guide members being formed up to a height corresponding to a height of the cylinder block.

The guide member may be configured to have a shape of a column having a triangular cross-section, and may be positioned such that a vertical edge of the guide member is fitted into the siamese portion.

The split cooling apparatus for an internal combustion engine having the above-mentioned configuration is capable of realizing split cooling in such a manner that the apparatus increases the temperature of the outer wall surface of the cylinder and promotes the flow of cooling water in an upper part of the cylinder block at the same time by reducing the heat transfer rate of the cylinder in a lower part of the cylinder block, thereby improving the performance of the internal combustion engine.

In addition, since the split cooling apparatus can normally realize split cooling, when an integrated valve is applied, the split cooling apparatus allows a split cooling port to be removed, thereby allowing the size, weight, and cost of the integrated valve to be reduced, and the control of the internal combustion engine to be simple and secure.

Furthermore, the split cooling apparatus can utilize an upper channel in the cylinder block and the outside of the base (a thermal mat) as a common chamber for cross flow of the cooling water, thereby realizing cross flow and split cooling at the same time.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
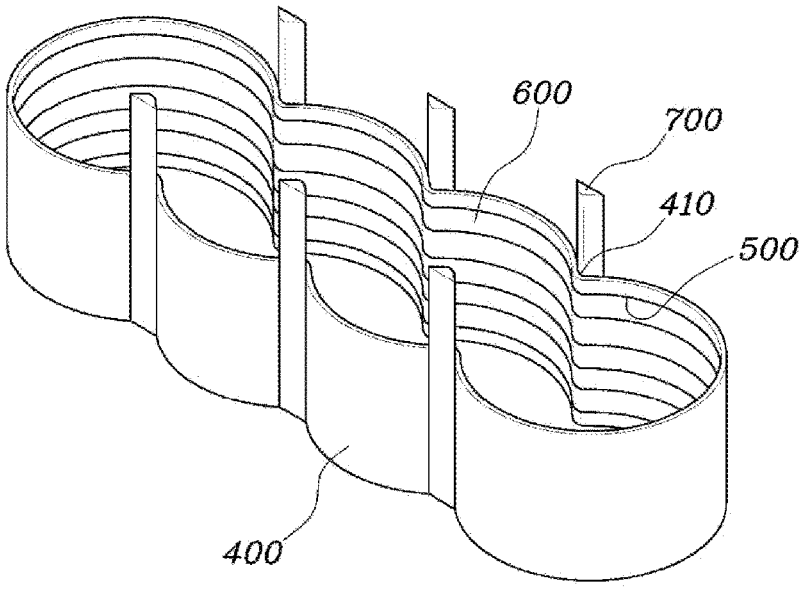
FIG. 1 is a perspective view showing a split cooling apparatus for an internal combustion engine according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
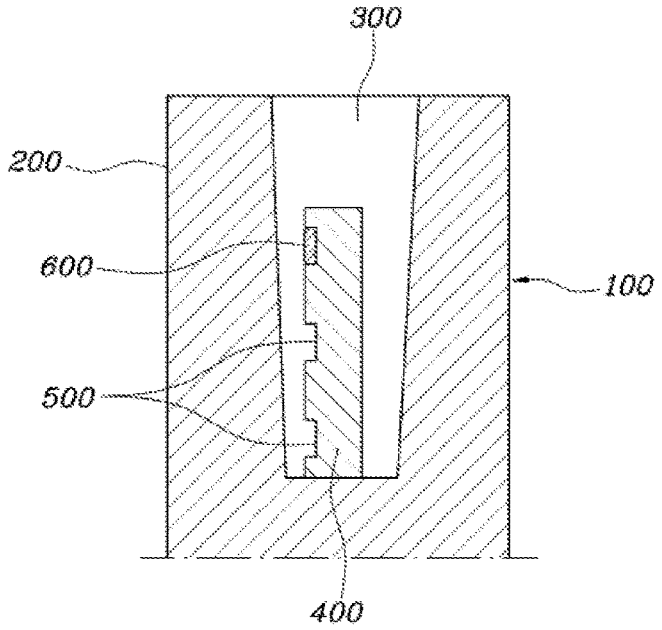
FIG. 2 is a side sectional view of a cylinder block equipped with the split cooling apparatus shown in FIG. 1 prior to the expansion of a sealing member.
Figure 3:
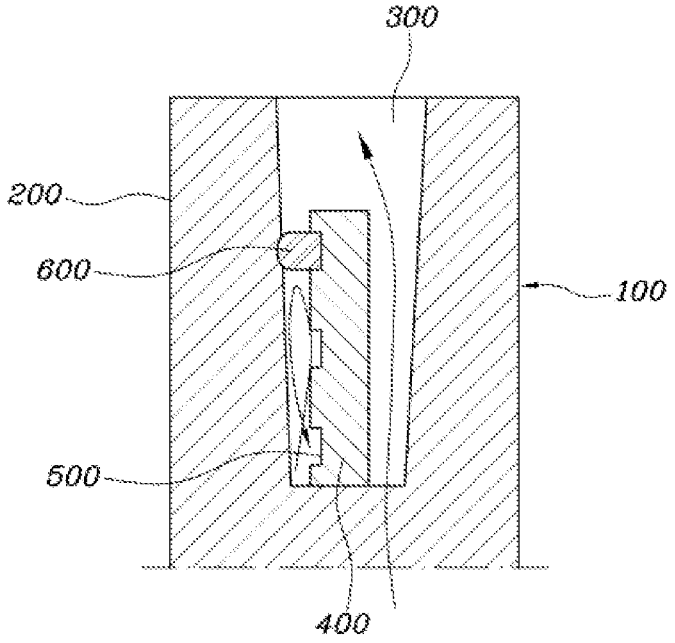
FIG. 3 is a view corresponding to FIG. 2, but showing a state of the cylinder block after the expansion of the sealing member.
Figure 4:
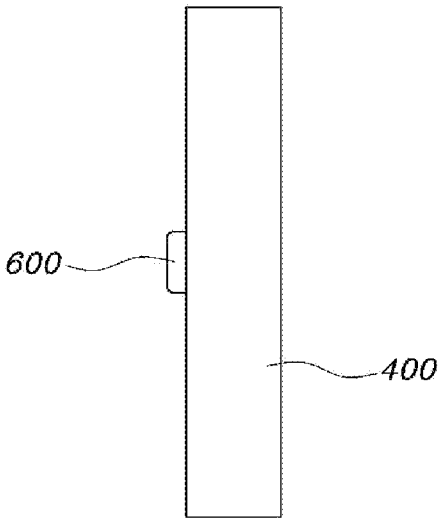
FIGS. 4 to 6 are side sectional views showing a split cooling apparatus for an internal combustion engine according to various forms of the present disclosure.
Figure 5:
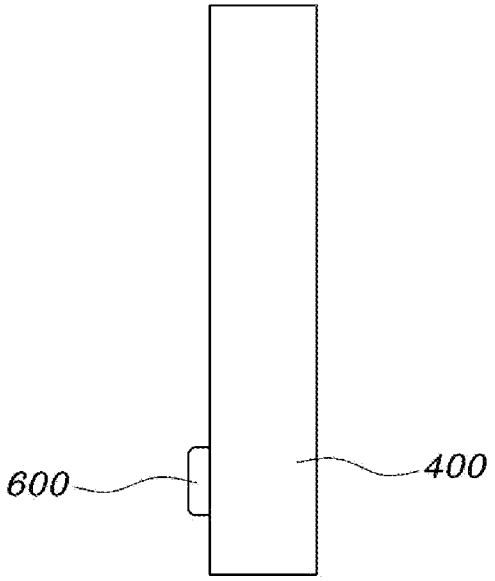
Figure 6:
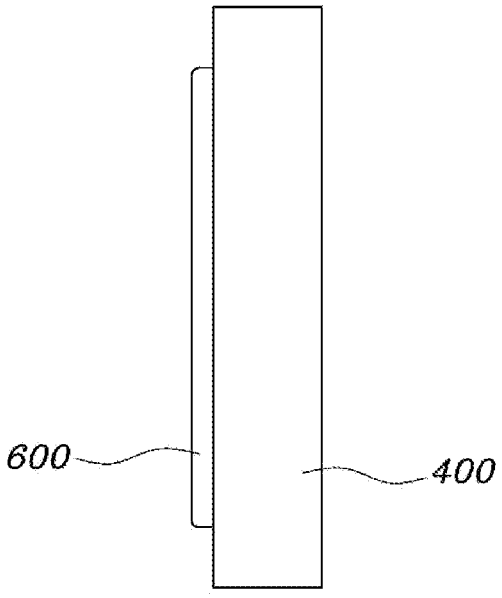

FIG. 1 is a perspective view showing a split cooling apparatus for an internal combustion engine according to one form of the present disclosure; FIG. 2 is a side sectional view of a cylinder block equipped with the split cooling apparatus shown in FIG. 1 prior to the expansion of a sealing member; FIG. 3 is a view corresponding to FIG. 2, but showing a state of the cylinder block after the expansion of the sealing member; and FIGS. 4 to 6 are side sectional views showing a split cooling apparatus for an internal combustion engine according to various forms of the present disclosure.

The split cooling apparatus for an internal combustion engine according to one form of the present disclosure includes: a base 400 inserted into a water jacket 300 of a cylinder block 100, the base surrounding an outside of a cylinder 200 along a shape of the cylinder 200; an insertion groove 500 formed on the base by being depressed into an inner surface of the base 400; and the sealing member 600 inserted into the insertion groove 500, wherein when a temperature of cooling water supplied into the water jacket 300 readies a preset temperature or higher, the sealing member expands to close a flow passage between the base 400 and the cylinder 200, thereby increasing flow resistance of the cooling water and thus reducing a heat transfer rate of the cylinder 200.

As shown in FIG. 1, the base 400 may be formed integrally with the cylinder 200 so as to surround the outside of the cylinder 200. The base 400 serves to divide a flow passage in the water jacket 300. Accordingly, although an inside and an outside of the base 400 are referred to as a flow passage of the cylinder 200 and an outside flow passage of the cylinder 200 respectively relative to the base 400, terms of the inside and outside of the base 400 will be used hereinbelow to describe the split cooling apparatus for an internal combustion engine.

Particularly, it is preferred that the base 400 is formed up to two thirds of a height of the cylinder block 100 from a lower end of the cylinder block 100. For in the application of normal split cooling according to the related art, the cylinder block 100 partially closes a flow passage of cooling water, and thus flow resistance of entire cooling water is increased, which decreases an amount of the entire cooling water. According to the present disclosure, the base 400 is formed so as to surround only two thirds of a lower part of the cylinder block 100, and thus does not cover an entirety of the water jacket 300, thereby minimizing a flow resistance increase of the flow passage of the entire cooling water, and preventing the amount of the cooling water from decreasing. Therefore, a split cooling structure of the present disclosure is more efficient in heating and cooling performance than a split cooling structure of the related art.

The insertion groove 500 is formed by being depressed into the inner surface of the base 400. Particularly, as shown in FIG. 1, it is preferred that the insertion groove 500 is formed to have a closed curve extending along a longitudinal direction of the base 400. This is because the insertion groove 500 is filled with the sealing member 600, and the sealing member 600 closes the flow passage between the base 400 and the cylinder 200, thereby increasing the flow resistance of cooling water and thus reducing the heat transfer rate of the cylinder 200.

As shown in FIGS. 2 and 3, according to one form of the present disclosure, the insertion groove 500 is formed on an upper part of the base 400. However, as shown in FIGS. 4 to 6, only one insertion groove 500 may be formed on a position appropriate to apply the sealing member 600. In addition, the insertion groove 500 may include a plurality of insertion grooves, the plurality of insertion grooves being arranged on the inner surface of the base 400 by being spaced apart from each other at predetermined intervals in a vertical direction. The number and positions of the insertion grooves 500 may be different depending on vehicle models, and may be changed according to designs of vehicles or circumstances, and thus are not limited to a specific position or number.

The sealing member 600 fills the insertion groove 500. The sealing member 600 may be made of an ethylene propylene diene m-class rubber (an EPDM rubber). The EPDM rubber as a thermoplastic synthetic rubber is a terpolymer of ethylene, propylene, and diene, and is configured to have no butadiene unlike a normal synthetic rubber. Accordingly, the EPDM rubber has excellent weatherproof and electric insulation qualities compared to normal synthetic rubber.

Accordingly, when fabricating the base 400, as shown in FIGS. 2 and 3, a clearance exists between the cylinder 200 and the base 400, but when a temperature of cooling water supplied into the water jacket 300 reaches the predetermined temperature or more, the sealing member 600 expands and seals the clearance between the cylinder 200 and the base 400. That is, the sealing member 600 is compressed after being formed so as to expand at the preset temperature or higher, and then is inserted into the insertion groove 500.

Accordingly, when combining the split cooling apparatus for an internal combustion engine according to the present disclosure with the water jacket 300, the clearance makes it easier to insert the split cooling apparatus into the water jacket. When the water jacket 300 is filled with cooling water, and a temperature of the cooling water readies the predetermined temperature or more, the sealing member 600 expands to close the flow passage between the base 400 and the cylinder 200, which divides a vertical flow of the cooling water, thereby increasing the flow resistance of the cooling water and reducing the heat transfer rate of the cylinder 200.

Therefore, a portion surrounded by the cylinder 200, the sealing member 600 and the base 400 is narrow, and thus the flow resistance is increased, thereby reducing the heat transfer rate of an outer wall surface of the cylinder 200, and thus increasing a temperature of the outer wall surface thereof. Particularly, since the flow resistance of the inside of the base 400 is increased, a major amount of the cooling water flows to the outside of the base 400 and an upper part of the cylinder block 100, and thereby split cooling can be normally realized.

In addition, the base 400 is provided with a guide member 700 at a siamese portion 410 thereof. Particularly, it is preferred that the guide member 700 is provided in every siamese portion 410 of the base 400. The guide member 700 may be formed up to a height corresponding to a height of the cylinder block 100. Additionally, the guide member 700 may be configured to have a shape of a column having a triangular cross-section, and may be positioned such that a vertical edge of the guide member is fitted into the siamese portion 410. Accordingly, the flow of the cooling water in the upper part of the cylinder block 100 is guided by the guide member 700, which increases cooling efficiency, and since a fabrication direction of the base 400 is determined by the guide member 700, the fabrication of the base is simplified, and the upper part and a lower part of the base 400 are determined by the guide member.

That is, as described above, the split cooling apparatus for an internal combustion engine according to one form of the present disclosure is capable of realizing split cooling in such a manner that the apparatus increases a temperature of the outer wall surface of the cylinder 200 and promotes the flow of cooling water in the upper part of the cylinder block 100 at the same time by reducing the heat transfer rate of the cylinder 200 in the lower part of the cylinder block 100, thereby improving the performance of an internal combustion engine.

In addition, since the split cooling apparatus can normally realize split cooling, when an integrated valve is applied, the split cooling apparatus allows a split cooling port to be removed, thereby allowing the size, weight, and cost of the integrated valve to be reduced, and the control of the internal combustion engine to be simple and secure.

Furthermore, the split cooling apparatus can utilize as a common chamber of a cross flow of the cooling water an upper channel in the cylinder block 100 and the outside of the base 400 (a thermal mat), thereby realizing the cross flow and the split cooling at the same time.

Although preferred forms of the present disclosure have been described for illustrative purposes, those skilled in the art will appreciate that various modifications, additions and substitutions are possible, without departing from the scope and spirit of the disclosure as disclosed in the present disclosure.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A split cooling apparatus for an internal combustion engine, the apparatus comprising:

a base inserted into a water jacket of a cylinder block, the base surrounding an outside of a cylinder along a shape of the cylinder, the base having an inside and an outside;

an insertion groove formed on the base and depressed into an inner surface of the base, wherein the base defines an inside flow passage and an outside flow passage relative to the base in the water jacket; and a sealing member inserted into the insertion groove, wherein, when a temperature of a cooling water supplied into the water jacket reaches a preset temperature or higher, the sealing member expands so as to close the inside flow passage between the base and the cylinder, thereby increasing flow resistance of the cooling water and reducing a heat transfer rate of the cylinder, wherein when the inside flow passage is closed, the cooling water in the outside flow passage flows to an upper part of the cylinder block from a bottom part of the outside of the base as a cross flow.

2. The apparatus of claim 1, wherein the base is formed up to two thirds of a height of the cylinder block from a lower end of the cylinder block.

3. The apparatus of claim 1, wherein the insertion groove is formed to have a closed curve extending along a longitudinal direction of the base.

4. The apparatus of claim 1, wherein the insertion groove is formed on an upper part of the base.

5. The apparatus of claim 1, wherein the insertion groove includes a plurality of insertion grooves, the plurality of insertion grooves being arranged on the inner surface of the base by being spaced apart from each other at predetermined intervals in a vertical direction.

6. The apparatus of claim 1, wherein the sealing member is made of an ethylene propylene diene m-class (EPDM) rubber, the sealing member being compressed after being formed so as to expand at the preset temperature or higher.

7. The apparatus of claim 1, wherein the base is provided with a guide member at a siamese portion thereof.

8. The apparatus of claim 7, wherein the guide member includes a plurality of guide members, the plurality of guide members being formed up to a height corresponding to a height of the cylinder block.

9. The apparatus of claim 7, wherein the guide member is configured to have a shape of a column having a triangular cross-section, and is positioned such that a vertical edge of the guide member is fitted into the siamese portion.

* * * * *